United States Patent [19]

Hassanzadeh et al.

[11] Patent Number: 4,625,762

[45] Date of Patent: Dec. 2, 1986

[54] AUTO-FILL FLOW VALVE

[75] Inventors: Hedayat H. Hassanzadeh, Houston; Guy L. McClung, III, Spring, both of Tex.

[73] Assignee: Weatherford U.S., Inc., Houston, Tex.

[21] Appl. No.: 796,665

[22] Filed: Nov. 8, 1985

[51] Int. Cl.[4] ..... F16K 31/12

[52] U.S. Cl. ..... 137/624.27; 251/66; 137/75

[58] Field of Search ..... 137/624.27, 75; 251/66

[56] References Cited

U.S. PATENT DOCUMENTS 3,385,372 5/1968 Knox ..... 166/225
4,067,358 1/1978 Streich ..... 137/624.27 X
4,488,566 12/1984 Hicks ..... 137/75 X

OTHER PUBLICATIONS

Tests Find Hammering, Fluid Cutting, Erosion Cause Float Shoe Failures, by William D. Stringfellow, published Jan. 21, 1985, by Oil & Gas Journal.

*Primary Examiner*—Alan Cohan
*Attorney, Agent, or Firm*—Fulbright & Jaworski

[57] ABSTRACT

An auto-fill flow valve for use in providing valving action in a conduit, the valve having a releasable locking mechanism which prevents the valving element from moving to seat against the valve seat until the locking mechanism is released. Also provided is a valve guide for receiving the releasable locking mechanism and holding it against the valving element.

13 Claims, 18 Drawing Figures

Fig. 4
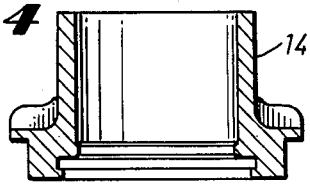
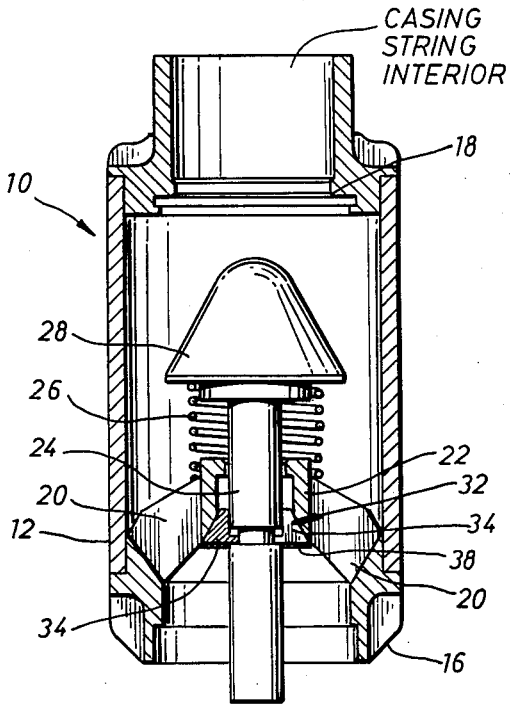
Fig. 1
Fig. 7
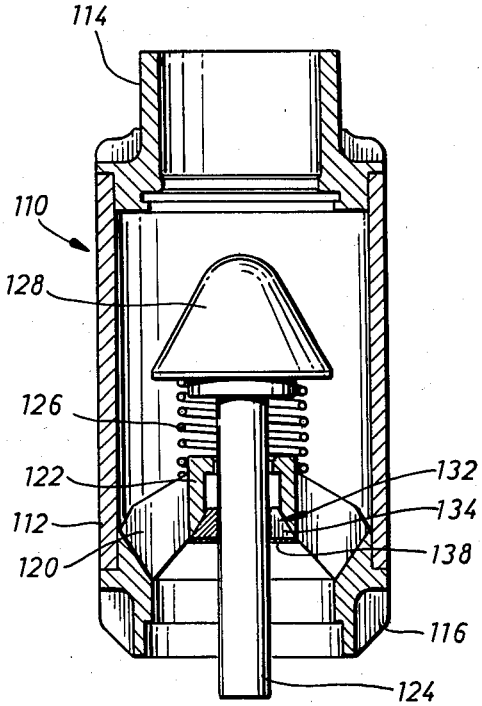
Fig. 8
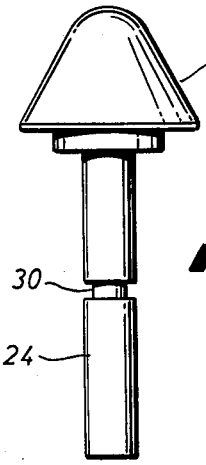
Fig. 2
Fig. 3
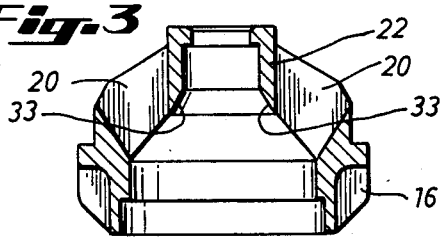
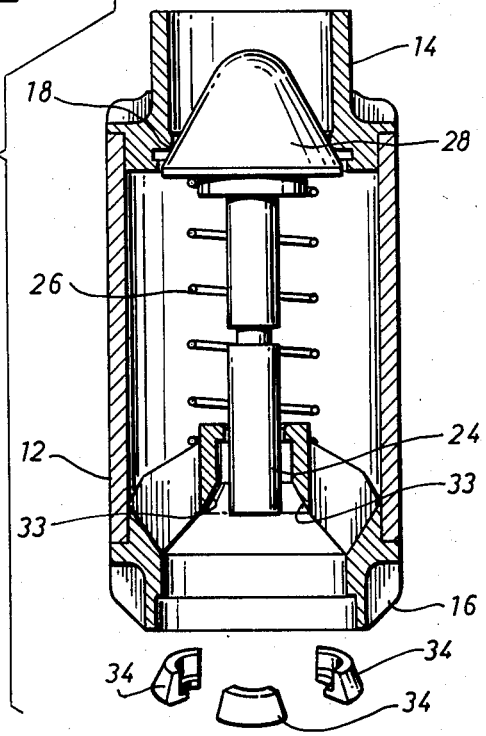

Fig. 5
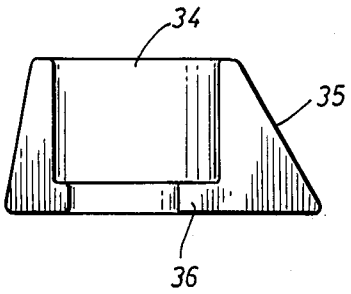
Fig. 6
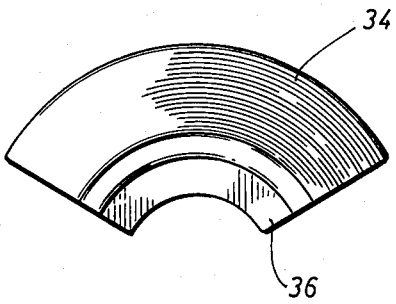
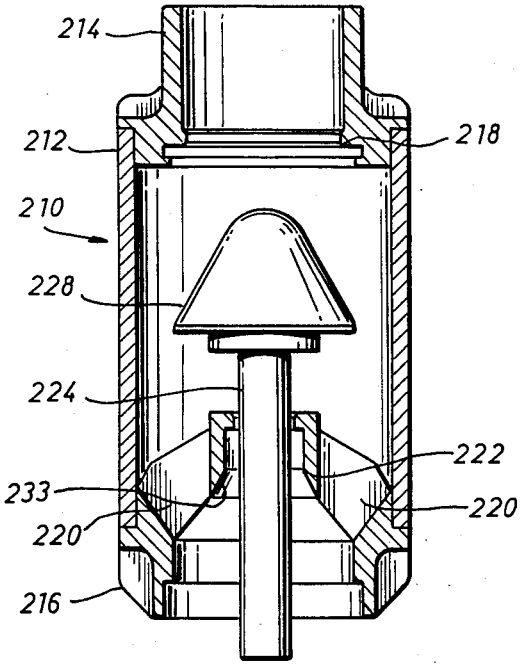
Fig. 13
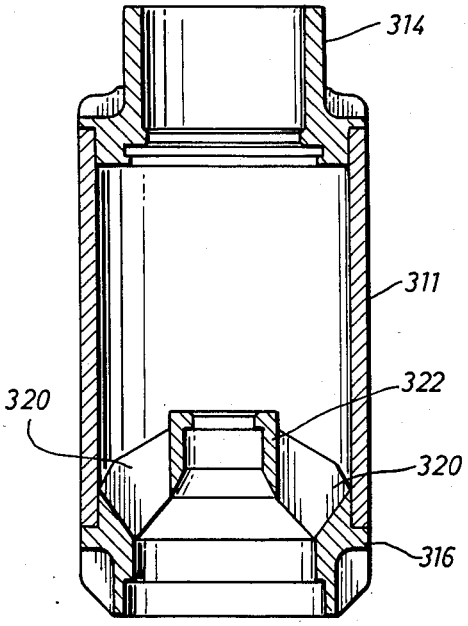
Fig. 14

Fig. 9
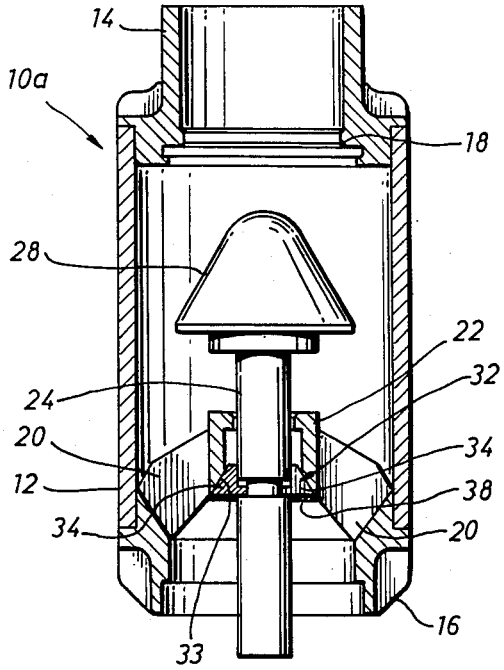
Fig. 10
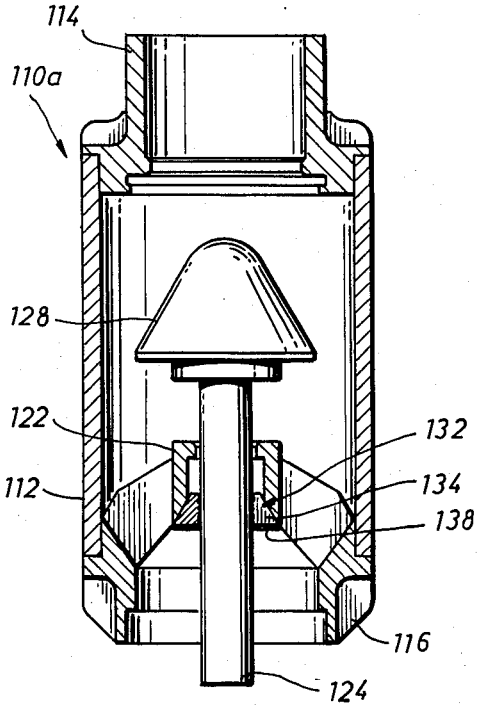
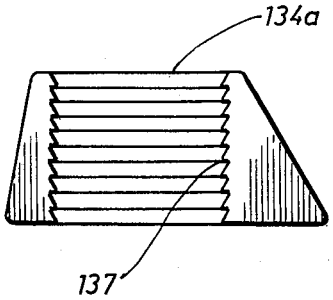
Fig. 11
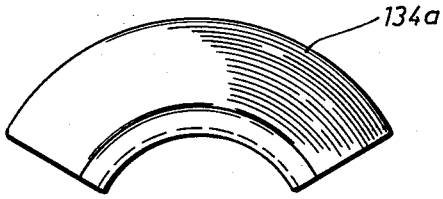
Fig. 12

AUTO-FILL FLOW VALVE

BACKGROUND OF THE INVENTION

1. Field of the Invention

This invention is directed to valves and to a float collar flow valve for use in wellbore operations. This invention is particularly directed to a float collar valve for use in running a casing string into a well and in cementing such a string; to a locking mechanism for preventing valve stem movement; and to a valve guide formed so as to be able to receive parts of a new locking mechanism.

2. Description of the Prior Art

In running a casing string in a bore hole, it is necessary to provide a valve for controlling the rate of flow of fluid from the bore hole into the casing. If the fluid is not controlled as it enters the bottom of the casing, the fluid pressure in the well may be sufficient to cause the fluid to blow out through the top of the casing. On the other hand, it is necessary to fill the casing gradually as it is lowered to compensate for the head of fluid on the outside of the casing to prevent implosion or collapse of the casing. Various self-fill float valves have been utilized for limiting the rate of flow of fluid into the casing, as it is being lowered into the bore hole.

After the casing has reached the desired depth, it is cemented in place by conducting cement down the casing and out through the bottom of the casing, where it flows upwardly through the annular space between the casing and the bore hole wall. Accordingly, it is necessary to provide a valve which will resist the back pressure of the cement slurry in the annulus. The back pressure valve, however, should prevent flow of the slurry back into the casing, while the self-fill float valve allows a restricted flow into the casing. Since these valves operate under different conditions and during different portions of the casing cementing process, it has been proposed to combine these valves in a single unit and to render the valves operative by various means. It is important that the valves operate effectively and reliably to ensure a successful cementing operation.

The flow control float collar valve described in U.S. Pat. No. 3,385,372 was an attempt to solve the problems already described. In this valve there is a collar having a tubular body with a valve guide in the body. A valve seat is formed in the body above the valve guide. A movable valve element is mounted in the valve guide in position to move upwardly into engagement with the valve seat and is spring biased toward the valve seat. A fluid reaction surface is mounted on the valve stem below the valve element. The fluid reaction surface is biased downwardly by a spring that applies a greater axial force to the valve stem than does the spring biasing the valve element. The fluid reaction surface is arranged to exert an upwardly directed force on the valve stem in response to the flow of fluid upwardly through the casing. Thus, the reaction surface restricts or limits the rate of flow upwardly by displacing the first valve element against the valve seat. There is a shear pin joining the reaction surface to the valve stem and, upon pumping fluid down the casing at a predetermined rate, the force of the fluid on the reaction surface breaks the shear pin and causes the reaction surface to be displaced downward and thereby rendered ineffective. After the shear pin is broken, the valve element is released and its spring urges the valve element against the valve seat.

Therefore, the collar is converted to a back pressure valve.

The valve has numerous disadvantages. The shear pin can be sheared by any force of sufficient strength such as the force of vibration when the valve is shipped or moved or the force of any impact on the valve e.g. if it is dropped on the rig floor. Once the shear pin is broken, the valve cannot converted back to a self-fill flow valve.

Another disadvantage of the valve is the limited flow rates of wellbore fluids or cement which are possible through the valve due to the blocking of the flow path by the surface reactive areas necessitated by the valve design. Because of this limitation on flow rate, the interior of the casing must be filled with wellbore fluid by pumping the fluid down the casing, rather than letting fluid enter the casing at the bottom of the casing string. Fluid simply cannot enter at the bottom of the casing fast enough to provide adequate pressure equalization between casing and wellbore due to the flow restrictions of the valve. Therefore fluid must be pumped down the casing to prevent casing collapse. Also, if the flow from the wellbore into the bottom of the casing string was at a relatively high rate, the shear pin could be sheared closing the valve and preventing any fluid from entering the casing; again causing casing collapse.

A float collar shell is a cylindrical shell member used to contain the valve. In use it forms a part of the casing string. The dimensions of a standard float collar shell are such that a valve such as the valve of U.S. Pat. No. 3,385,372 does not fit in the standard shell because of the added length necessary to accommodate the valve's fluid reactive mechanism. Also, the prior art flow valves are manufactured and delivered as a unit which cannot be modified, i.e. they cannot be converted on the rig to an automatic fill mode because the fluid reactive mechanism is an integral part of the valve and must be assembled with the valve during manufacture. Also it is practically impossible to add a shear pin to an already manufactured valve such as the shear pin necessary in the valve of U.S. Pat. No. 3,385,372.

One of the primary disadvantages of a valve according to U.S. Pat. No. 3,385,372 is the imprecision of and hence the unpredictability of the performance of the shearing mechanism and the valve closure mechanism. This imprecision is due to the numerous engineering, design, and manufacturing characteristics of these mechanisms. The shearing of the shear pin depends on all of the following variables:

a. The pressure differential across the fluid reactive member.
b. The material and dimensions of the pin.
c. The characteristics of the spring which biases the fluid reaction surface downwardly (thereby creating an upward, i.e. shearing, force on the pin).

A failure or inadequacy related to the design, selection, or manufacture of any of these variables can result in a shear pin that shears too soon, too late, or which never shears at all.

In accordance with § 1.56 of the 37 C.F.R., applicants are aware of U.S. Pat. No. 3,385,372 and a publication entitled "Tests find hammering, fluid cutting, erosion cause float shoe failures," by William D. Stringfellow published Jan. 21, 1985 by OIL & GAS JOURNAL, copies of which are submitted herewith.

SUMMARY OF THE INVENTION

Accordingly the present invention is directed to an automatic fill flow valve which overcomes the problems of the prior art valves, which can easily be converted to a backflow preventer and which provides valving action in a new and efficient manner. A valve according to the present invention has a valve stem movably mounted in a bottom cap. A plunger is provided on the top of the valve stem for contacting and seating in a valve seat of a top cap to close off the valve. The top and bottom caps are connected to a body which houses the valve. A spring urges the valve stem toward the seat. A releasable positive locking mechanism is provided for preventing upward movement of the valve stem which would allow the valve to close. In one embodiment the locking mechanism includes a segmented locking ring which either coacts with the valve stem to hold it by frictional contact or which coacts with a locking groove in the stem. The locking ring can be maintained in position with the aid of holding member such as a gasket or amounts of an adhesive. The bottom cap has a plurality of ribs extending from the cap's outer circumference toward the center. A hollow guide valve cylinder is mounted at the center of the bottom cap on the ribs and the valve stem is movably disposed within this hollow cylinder. In one embodiment a recess in the cylinder receives the locking ring segments so that they contact the valve stem and hold it. In another embodiment the locking segments are disposed in a groove in the stem and held against the bottom of valve guide cylinder. Downward force on the stem releases the locking segments permitting the stem to move to close off the valve. This valve can be manufactured so that it is possible to easily convert it to its automatic fill mode after it has left the factory by adding the releasable locking mechanism at the job location.

As compared to valves such as the valve of U.S. Pat. No. 3,385,372, a valve according the present invention is much more precise and accurate because some of the characteristics contributing to the imprecision and unpredictability of the prior art valves have been eliminated. For example, since there is no shear pin the problems associated with the selection of material, design, and dimensions for a shear pin are avoided. Also, the lower spring used in the prior art valves for biasing the fluid reaction surface downwardly has been eliminated as has the complex fluid reaction mechanism. The result is a more precise, more predictable valve which is converted to a backflow preventer only when such conversion is desired.

It is therefore an object of the present invention to provide an efficient flow valve.

Another object of the present invention is the provision of such a valve which can serve as an automatic fill valve for permitting wellbore fluid to flow into a casing string.

Yet another object is the provision of such a valve which can easily be converted to an automatic fill valve on site.

A further object of this invention is the provision of such a valve which can be used with a standard float collar shell.

An additional object of this invention is the provision of such a valve having a releasable locking mechanism for holding the valve stem until a desired downward pressure is applied to the valve stem releasing the locking mechanism, permitting the valve plunger to seat closing off the valve, and thereby converting the valve into a backflow preventer.

Another object of the present invention is to provide a valve with sufficient unrestricted flow area to permit wellbore fluid to pass from the wellbore, through the valve and into the casing string while the locking mechanism holds the valve stem and prevents the plunger from moving upwardly to the valve seat.

Yet another object of the present invention is the provision of such a valve which eliminates or reduces the need for pumping wellbore fluid down the casing to equalize the pressure in the casing and the pressure in the wellbore. Operations with such a valve will be much more economical since the expense of pumps and operators therefor is eliminated or reduced.

A further object of the present invention is the provision of such a valve in which the releasable locking mechanism includes a locking ring made up of one or more locking segments which either hold the valve stem in a bottom cap by frictional contact, by toothed contact, or by engaging a groove in the stem.

An additional object of the present invention is the provision of such a valve which permits a significantly higher flow rate than prior art valves.

A particular object of the present invention is the provision of a positive releasable locking mechanism which does not unlock in response to accidental impacts, dropping, or vibration.

Another object of the present invention is the provision of such a valve in which a holding member is used to assist in maintaining the locking mechanism in place in the bottom cap cylinder until conversion of the valve is desired.

To one of skill in this art who has the benefit of this invention's teachings, other and further objects, features and advantages will become clear from the following description of the presently preferred embodiments of the invention, given for the purpose of disclosure, and taken in conjunction with the accompanying drawings.

DESCRIPTION OF THE DRAWINGS

FIG. 1 is a cross-sectional view of a valve according to the present invention with the releasable locking mechanism in place.

FIG. 2 is a cross-sectional view of the plunger and valve stem of the valve of FIG. 1.

FIG. 3 is a cross-sectional view of the bottom cap of the valve of FIG. 1.

FIG. 4 is a cross-sectional view of the top cap of the valve of FIG. 1.

FIG. 5 is perspective side view of a segment of a locking ring according to the present invention.

FIG. 6 is a top view of the segment of FIG. 5.

FIG. 7 is a cross-sectional view of a valve according to the present invention with the releasable locking mechanism in place.

FIG. 8 is a cross-sectional view of the valve of FIG. 1 after the locking mechanism has been released and the valve has closed.

FIG. 9 is a cross-sectional view of another embodiment of the valve of FIG. 1 in which no spring or other upwardly urging means is used.

FIG. 10 is a cross-sectional view of another embodiment of the valve of FIG. 7 in which no spring or other upwardly urging means is used.

FIG. 11 is a perspective side view of a segment of a locking ring according to the present invention.

FIG. 12 is a top view of the segment of FIG. 11.

FIG. 13 is a cross-sectional view of a valve according to the present invention.

FIG. 14 is a cross-sectional view of a valve housing according to the present invention.

Figure 15:
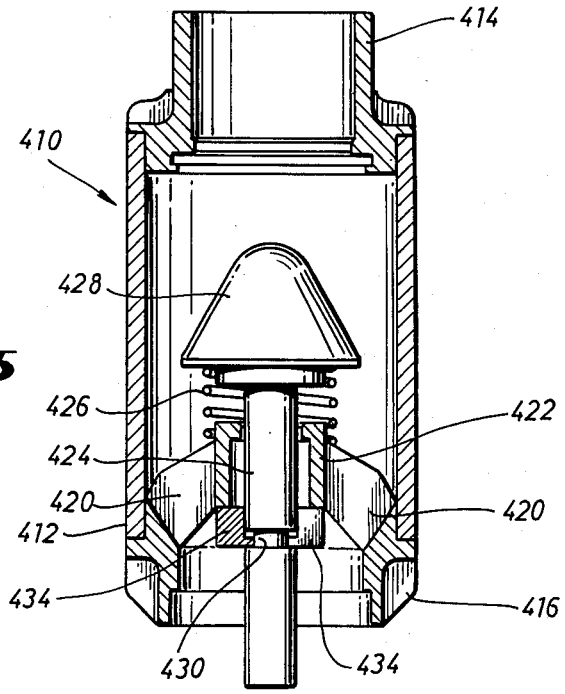
FIG. 15 is a cross-sectional view of another embodiment of a valve according to the present invention.

All figures are drawn to scale (although the scale of each figure is not identical) and a dashed line represents a centerline.

DESCRIPTION OF PREFERRED EMBODIMENTS

Referring to FIGS. 1–4, the valve 10 has the tubular member 12 to which are connected the top cap 14 and the bottom cap 16. The valve seat surface 18 is provided in the top cap 14. The bottom cap 16 has the inwardly and upwardly directed ribs 20 for supporting the valve guide cylinder 22. The valve stem 24 is movably disposed within the cylinder 22. The spring 26 mounted about the valve stem 24 and abutting the tops of the ribs 20 urges upwardly the valve stem 24 with its plunger 28.

The valve stem 24 is provided with the circumferential groove 30 for receiving a portion 36 of the segments 34 of the locking ring 32. As shown in FIG. 5 the segments 34 have a lower bar portion 36 which is received by the groove 30 of the valve stem 24 as shown in FIG. 1. The lower part of the cylinder 22 is formed as an inwardly tapering conical section 33 to receive the segments 34. The segments 34 have the tapering side 35 whose taper conforms to the taper of the conical section 33. Because of the upward thrust of the spring 26 the valve stem 24 pulls up on the segments 34 holding them in place and thereby locking the valve stem itself and preventing its upward movement.

FIG. 8 illustrates the valve 10 in closed position after the valve stem 24 has first been moved downwardly, for example by the force of fluids pumped down the casing, releasing the segments 34 and then moved upwardly in response to the action of the spring 26 to bring the plunger 28 into contact with the valve seat surface 18 closing off the valve 10 and stopping the flow of fluids between casing the wellbore. The segments 34 have fallen free.

Although in the embodiments described here in detail the segments of the various locking rings are conically tapered and the valve guide cylinders have a conforming inwardly directed conical taper, it is to be understood that the present invention is not limited to the conical shape and that any shape is within the scope of this invention which permits the segments to contact the stem and be disposed within or partially within the valve guide cylinder or to abut the bottom of the valve guide so long as they fall away when released.

The embodiment of the valve 110 according to the present invention shown in FIG. 7 has the segmented locking ring 122 but no groove in the valve stem 124. The segments 134 of the ring 122 contact the valve stem 124 and hold it due to the frictional force created between the segments 134 and the surface of the valve stem 124. If desired the surfaces of the segments 134 which contact the valve stem can be roughened or can be formed with small teeth to better hold the valve stem. As shown in FIGS. 11 and 12, in one embodiment the segments 134 for the valves 110 (FIG. 7) and 110*a* (FIG. 10) can have the structure of segment 134*a*. The segments 134*a* do not have the protruding bar portion 36 as do the segments 34 (FIG. 5); but the segment 134*a* does have a toothed surface 137 for facilitating the engagement and holding of a valve stem such as stem 124. But for the different configuration of the segments 134 and the absence of the groove 30, the valve 110 corresponds to the valve 10 of FIGS. 1–4 and 8.

As shown in FIGS. 1 and 7 a holding member such as the gasket 38 (FIG. 1) or gasket 138 (FIG. 7) can be employed to assist in maintaining the segments 34 or 134, respectively, in their positions within their respective cylinders. In its preferred embodiment this gasket is a water soluble material which is relatively weak such as thin cardboard which is glued to the bottom of the segments.

As shown in FIGS. 9 and 10 it is within the scope of this invention to provide a valve in which there is no spring or other urging member urging the valve stem toward the valve seat. The valve 10*a* of FIG. 9 is substantially similar to the valve 10 of FIG. 1 but for the absence of the spring 26 of valve 10. The valve 110*a* of FIG. 10 is substantially similar to the valve 110 of FIG. 7 but for the absence of the spring 126 of valve 110. The deletion of the springs 26 and 126 requires that the lock rings 32 and 132 be firmly held within their respective valve guide cylinder 22 and 122. To facilitate this an amount of adhesive can be used to hold the segments of the ring to the surface of the cylinder or to the surface of the valve stem. Such an adhesive may be necessary if the weight of the valve stem is sufficient to dislodge the segments.

FIG. 13 illustrates the valve 210 according to the present invention having the tubular member 212 to which are connected the top cap 214 and the bottom cap 216. The valve guide cylinder is supported by the ribs 220 which are connected to the interior of the bottom cap 216. The valve stem 224 with its connected plunger 228 is movable within the valve guide cylinder 222. As illustrated the valve 210 can serve as a backflow preventer valve. Also due to the recess 233 formed in the bottom of the cylinder 222, it is possible to easily convert this valve to an automatic fill valve by inserting releasable locking parts such as the segments 134*a* (FIG. 11). With the segments in place the valve stem would be prevented from moving thereby permitting the flow of wellbore fluids into the casing. Once sufficient fluid has been pumped down the casing to move the valve stem downward releasing the locking mechanism, the valve is converted to a backflow preventer; then once there is sufficient flow from the wellbore into the casing, the force of the flow will move the plunger 228 and valve stem 224 so that the plunger 228 seats against the valve sear surface 218 closing off the valve.

FIG. 14 illustrates the housing 311 for a valve. The housing 311 has the top cap 314 and the bottom cap 316 connected to it. The ribs 320 connected to the bottom cap 316 support the valve guide cylinder 322. The lower portion of the cylinder 322 tapers outwardly from the center of the cylinder so that it can receive parts of a releasable locking mechanism such as the segments 34 (FIG. 1), segments 134 (FIGS. 7, 10) or segments 134*a* (FIG. 11).

FIG. 15 illustrates the valve 410 according to the present invention. Valve 410 is similar to the valve 10 (FIG. 1); but in the valve 410 the valve guide cylinder 422 is a conventional valve guide cylinder. The valve stem 424 has the groove 430 for receiving the locking segments 434. The segments 434 do not intrude into the cylinder 422 but do abut the bottom end of the cylinder 422. The upward force of the spring 426 forces the stem 424 upwardly which in turn holds the segments 434 up against the cylinder 422. Of course the valve 410 may be modified, as hereinbefore described for other embodiments, to delete the spring 426 providing means are employed such as an adhesive to hold the segments 434 in place. Similarly adhesives may be used with the valve 410 to adhere the segments 434 to each other or to the bottom of the cylinder 422 and connecting gaskets maybe used at the bottom of the segments 434 if needed.

Figure 16:
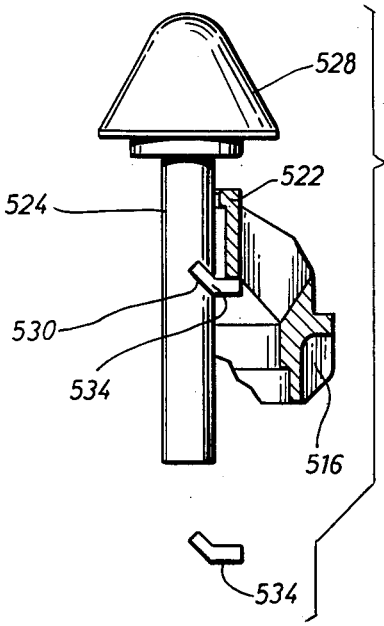
FIG. 16 shows another embodiment of the invention.

FIG. 16 illustrates the stem 524 which may be used with various valves according to the present invention; for example, with valve 410 (FIG. 15). The stem has the recess 530 for receiving the stud 534. The stud 534 abuts the bottom of the valve guide cylinder 522 to prevent movement of the stem 524. Upon the application of pressure on the stem 524 in a direction opposite to the direction in which the plunger 528 points, the stud 534 will be moved out of contact with the cylinder 522 and will fall out of the recess 530 permitting the movement of the stem 524 in the direction in which plunger 528 points. If necessary, adhesive can be used between the stud 534 and the bottom of the cylinder 522. One or more stud-recess combinations may be used in the stem. FIG. 16 is a cross-sectional view drawn to scale.

Figure 17:
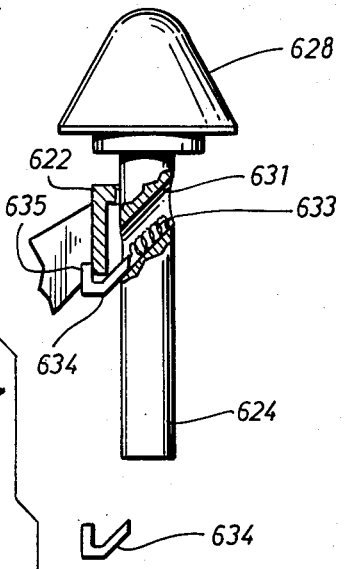
FIG. 17 shows another embodiment of the invention.

FIG. 17 illustrates another embodiment of a valve stem and locking mechanism according to the present invention; but the locking mechanism upon release is retracted into a hole in the stem by spring action rather than falling away from the valve. The arm 634 has the lip 635 which abuts the outer surface of the conventional guide means cylinder 622 (shown partially). The arm 634 is connected to the spring 633 which in turn is connected to the stem 624. Upon movement of the stem 624 in a direction opposite the direction in which the plunger 628 points, the lip 635 disengages from the cylinder 622 and the spring action retracts the arm 634 into the hole 631 permitting the stem 624 to move in the direction in which the plunger 628 points. This stem 624 can be used in conventional float valve housings such as illustrated in FIG. 15. FIG. 17 is a cross-sectional view of a valve stem and locking means according to the present invention showing part of a valve guide cylinder. FIG. 17 is not drawn to scale.

The segments 34, 134, 134*a*, the stud 534 and the arm 634 should be made from material which is non-frangible under normal operating conditions. The preferred material is metal and the preferred metal is aluminum.

Figure 18:
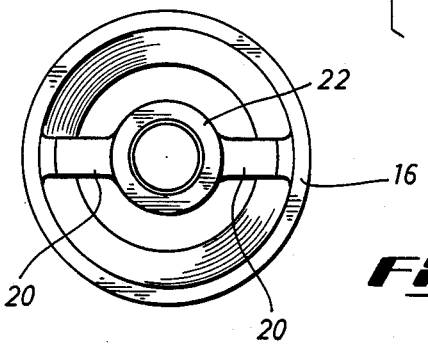
FIG. 18 is a top view of a bottom cap which may be used in any of the embodiments.

FIG. 18 is a top view of a bottom cap such as the caps 16, 116, 216, 316 or 416. The cap has the outer circular member 16*a*, the inwardly extending ribs 20*a* (corresponding to ribs 20, 120, 220, 320 and 420) and the valve guide cylinder 22*a* (corresponding to a top view of the cylinders 11, 122, 222, 322, 422, 522, and 622 although the bottom portions of these cylinders may differ).

In conclusion, therefore, it is seen that the present invention and the embodiments disclosed herein are well adapted to carry out the objectives and obtain the ends set forth. To one of skill in this art who has the benefits of the teachings of this invention it will be apparent that certain changes can be made in the structure of the devices without departing from the spirit and scope of this invention. Such changes might include a non-water soluble holding member; a holding member comprised of a layer of an adhesive, for example hardened epoxy or glue; a holding member disposed between the sides of the segments such as an amount of adhesive to hold the segments together; or an amount of adhesive between each segment and the conical section 33. Also although the segmented locking ring presented (as in FIG. 8) has a ring comprised of three segments, it is to be understood that one, two, or more than three segments of appropriate dimensions could be used. The present invention is, therefore, well adapted to carry out the objects mentioned, as well as others inherent therein.

What is claimed is:

1. A releasable locking mechanism for a valve, the valve having a body and a valve stem movably mounted in a guide means in the body, the valve having a seat towards which the stem is movable, the valve closing upon the stem sealingly contacting the seat, the releasable locking mechanism comprising locking means disposable in coacting relationship with the stem for holding the stem to prevent the movement of the stem toward the seat, the locking means disposable to abut the guide means and maintained in contact therewith, the locking means formed so that upon the application of a sufficient force to the stem in a direction away from the seat the locking means is releasable and can fall away from the valve.

2. The releasable locking mechanism of claim 1 wherein the locking means is comprised of one or more segments.

3. The releasable locking mechanism of claim 2 wherein the guide means has a recess therein formed to receive the segments and facilitate in maintaining the segments in holding contact with the stem.

4. The releasable locking mechanism of claim 1 wherein the stem has groove means therein for receiving a portion of the locking means to facilitate in maintaining the position of the locking means prior to its release.

5. The releasable locking mechanism of claim 3 wherein the stem has groove means for receiving a portion of the locking means to facilitate in maintaining the position of the locking means prior to its release.

6. The releasable locking mechanism of claim 2 wherein at least one of the one or more segments has teeth formed on the surface that contacts the stem, the teeth engaging the stem to facilitate in holding the stem prior to the release of the locking means.

7. The releasable locking mechanism of claim 1 including holding means for adhering the locking means to the guide means, the holding means being of insufficient strength to prevent release of the locking means.

8. The releasable locking mechanism of claim 2 including holding means for adhering at least two segments of the locking means to each other to facilitate the maintaining of their position prior to release.

9. A valve for controlling fluid flow through a conduit, the valve comprising a body means, guide means mounted to and within the body means, valve element means movably disposed within and guided by the guide means, the valve element means having valve stem means connected thereto, the stem means extending into the guide means, the seat means connected to the body means and spaced apart from the guide means, the stem means having a portion thereof suitable for sealingly contacting the seat means upon movement of the stem means to the seat means, releasable locking means connected to and retractable to the stem means, the releasable locking means having arm means with lip means connected to the arm means, the lip means able to engage the guide means for preventing movement of the stem means toward the seat means, the locking means formed so that when released it is retracted into the stem means by the action of spring means connected to the arm means and to the stem means.

10. A valve for controlling fluid flow through a conduit, the valve comprising a body means, guide means mounted to and within the body means, valve element means movably disposed within and guided by the guide means, the valve element means having valve stem means connected thereto, the stem means extending into the guide means, the seat means connected to the body means and spaced apart from the guide means, the steam means having a portion thereof suitable for sealingly contacting the seat means upon movement of the stem means to the seat means, releasable locking means disposed in coacting relationship with the stem means for preventing movement of the stem means toward the seat means, the locking means formed so that when released it falls away from the valve, the guide means including hollow means for receiving and guiding the stem means, the hollow means having recess means integrally formed in the bottom thereof for receiving the releasable locking means, the releasable locking means engagingly contacting the stem means and abutting the recess in the cylinder to prevent movement of the stem means toward the seat means, the recess means being conically tapered inwardly and the releasable locking means having a side with a taper corresponding to the taper of the recess means, said side abutting the tapered recess means.

11. The valve of claim 10 wherein the releasable locking means is comprised of one or more segments.

12. The valve of claim 10 wherein the releasable locking means has a lower protruding bar and groove means are provided in the stem means for receiving the lower protruding bar of the releasable locking means for facilitating the maintenance of the position of the releasable locking means until it is released.

13. The valve of claim 10 wherein the releasable locking means comprises stud means insertable in and releasable from a downwardly and outwardly extending recess in the stem means, the recess disposed so that the stud means abuts the guide means to prevent movement of the stem means toward the seat means.

* * * * *